US005628884A

United States Patent [19]

Leudolph et al.

[11] Patent Number: 5,628,884

[45] Date of Patent: May 13, 1997

[54] DEVICE AND PROCESS FOR THE ELECTROLYTIC SEPARATION OF METALS WITH THE AID OF A ROTATING CATHODE SYSTEM

[75] Inventors: Jurgen Leudolph, Niederbipp; Frank Roselt, Kestenholz, both of Switzerland

[73] Assignee: Ingenieuburo und Labor Fur Galvanotechnik, Niederbipp, Switzerland

[21] Appl. No.: 495,423

[22] PCT Filed: Nov. 8, 1994

[86] PCT No.: PCT/CH94/00217

§ 371 Date: Nov. 13, 1995

§ 102(e) Date: Nov. 13, 1995

[87] PCT Pub. No.: WO95/13408

PCT Pub. Date: May 18, 1995

[30] Foreign Application Priority Data

Nov. 8, 1993 [CH] Switzerland ..... 3348-93

[51] Int. Cl.[6] ..... C25B 11/02; C25C 7/02; C25D 17/12

[52] U.S. Cl. ..... 204/212; 204/213; 204/272; 204/279; 204/280; 204/284; 204/286

[58] Field of Search ..... 204/212, 213, 204/272, 286, 284, 280, 279

[56] References Cited

U.S. PATENT DOCUMENTS

| | | | |
|---|---|---|---|
| 1,535,577 | 4/1925 | Cleave | 204/216 |
| 3,507,770 | 4/1970 | Fleming | 204/272 |
| 3,806,434 | 4/1974 | Goold et al. | 204/212 X |
| 3,919,070 | 11/1975 | Goold et al. | 204/212 X |
| 4,102,770 | 7/1978 | Moriarty et al. | 204/212 X |
| 4,229,279 | 10/1980 | Price et al. | 204/213 X |
| 5,472,592 | 12/1995 | Lowery | 204/286 X |

*Primary Examiner*—Kathryn L. Gorgos
*Assistant Examiner*—John S. Starsiak, Jr.
*Attorney, Agent, or Firm*—Merchant, Gould, Smith, Edell, Welter & Schmidt, P.A.

[57] ABSTRACT

A device for the electrolytic separation of metals in a metal recovery cell has a rotating cathode system. The rotating cathode includes a supporting cylinder with at least one slit, at least one sheathed cathode, contact elements, and a drive shaft provided with a current supply. The device allows simple manipulation of the supporting cylinder with the sheathed cathode and allows the user to choose the choice of material for the sheathed cathode, since this material can be matched as closely as possible to the particular process in question. The process may be used for extracting metals from electrically conductive, metal-containing solutions for recycling purposes.

12 Claims, 3 Drawing Sheets

DEVICE AND PROCESS FOR THE ELECTROLYTIC SEPARATION OF METALS WITH THE AID OF A ROTATING CATHODE SYSTEM

The invention pertains to a device for the electrolytic separation/deposition of metals with the aid of a rotating cathode system and a process for the operation of the device according to patent claim 1 or 10.

Electrolysis devices are known for the separation of metals from solutions, in which the electrodes are arranged as plates in packet-form. This causes often the observance of shorts or, due to faulty contacts, uncontrollable current densities occur (0.1–1 amp/dm$^2$) that cause time and time again varying depositions. Furthermore, the flow conditions are difficult to control, resulting also in inhomogeneous depositions. In order to compensate for these disadvantages, lower current densities are employed that result in long deposition times and, therefore, become economically undesirable, or larger installations are employed, resulting in additional costs for the installation.

According to U.S. Pat. No. 5,183,544, a metal recovery system is known that allows the metal recovery from filter cakes. In a pretreatment, the metal-containing filter cake parts are brought into suspension and added to an electrolyte in which the metals are deposited onto a rotating cathode. This cathode is a nickel-covered or chrome-covered aluminum. It must every time be provided in a newly prepared form, which is disadvantageous. Furthermore, the cathode has to be worked up after completed deposition before it can be returned to the process.

It is the purpose of the present invention to disclose a device for the electrolytic deposition of metals and a process for its operation which provide a rotating cathode system that is of compact design and simple to operate, precipitates the metals compactly and homogeneously and, therefore, is particularly suitable for metal recovery.

According to the invention, this goal is achieved with a device according to the wording of patent claim 1, and a process according to the wording of patent claim 10. In claims 2–9 a form of execution for these is given. The invention is in the following described in more details on hand of the drawings.

BRIEF DESCRIPTION OF DRAWINGS

FIG. 1 depicts the principle of the rotating cathode system in an electrolysis unit schematically. On a support/installation frame 1 is a container 2 situated that contains the electrolyte 3, and into which a cylindrical pipe 4 is welded. A drive shaft 5 is inserted through this pipe and supported by the bearings 6 and 6' and that is driven by an adjustable drive 7 with the aid of a gear belt 8 and at its upper end is equipped with a flange 9. The pipe extends above the level 16 of the electrolyte, whereby a run-off of the electrolyte is prevented. The electrolyses unit is fed with the electrolyte or respectively emptied through the inlet 17 or the overflow 18.

Figure 1:
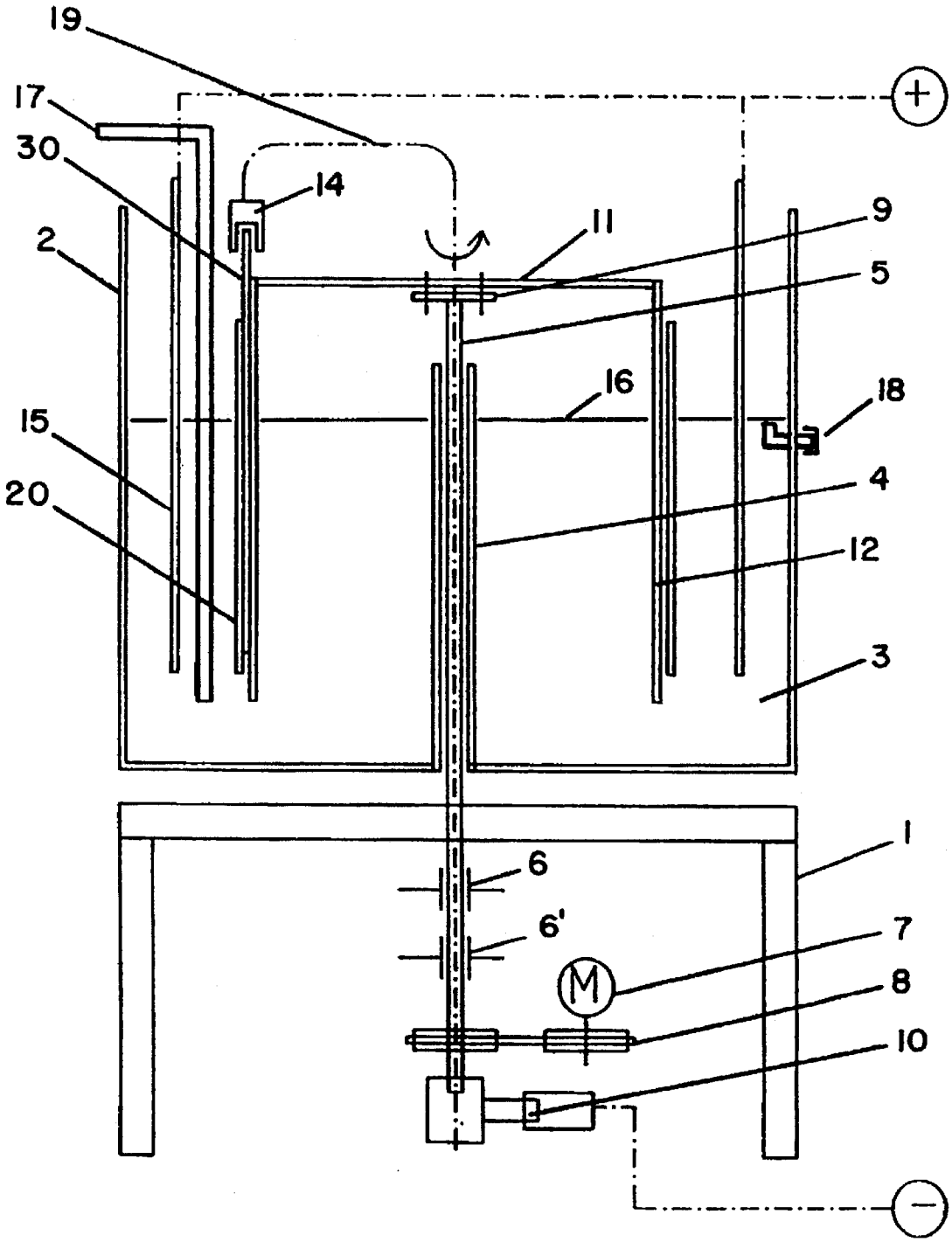
FIG. 1 Principle of the rotating cathode system in an electrolysis unit in schematic depiction.

Therefore, the device is also suitable for a cascade arrangement of several such units.

The drive shaft, here, e.g., constructed as a hollow shaft, conducts the current flow on the cathode side, for which a sliding body 10 is provided. The drive shaft requires a certain rigidity and—in case it is supposed to serve simultaneously as current feed—is manufactured from a metal alloy such as hard bronze or hard copper. If the drive shaft is designed as a hollow shaft, it is, e.g., made of stainless steel, which has a positive influence on the corrosion properties. The power feed 19 may then be handled by a copper conductor. Attached to flange 9 is a support cylinder 11 so that its cylinder walls 12 dip into the electrolyte. On the outside of the support cylinder a mantle cathode 20 is fastened, to which the current supply 19 occurs over a contact rod 30 with a socket 14, as is described further down. The current supply on the anode side occurs in known manner with bar electrodes or plate electrodes 15. Suitable materials for the mantle cathode 20 are foils, gauzes, webs, braids, nonwovens, foam or similar ones of metal or plastic.

Figure 2:
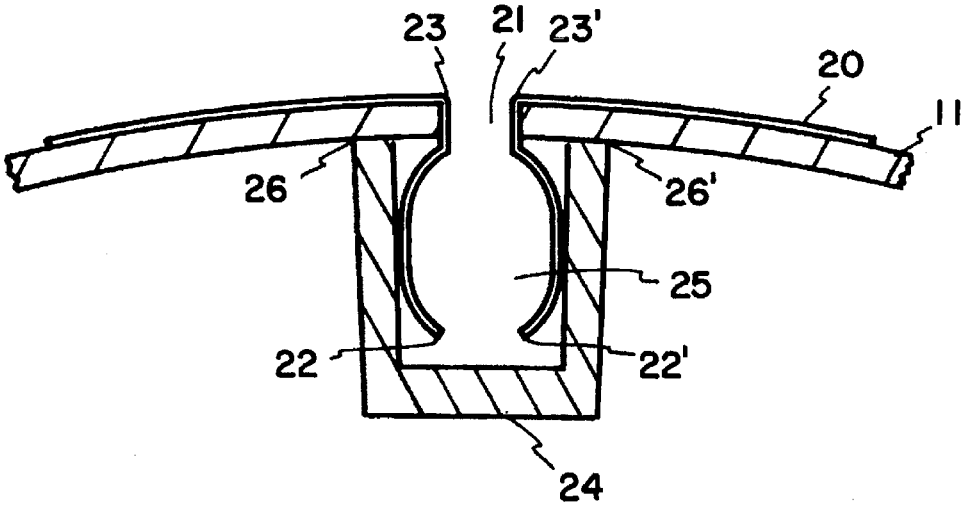
FIG. 2 Part of a support cylinder in section without contact rod.

FIG. 2 depicts a part of a support cylinder in section. Support cylinder 11 is provided with one or several narrow slots 21, into which the mantle cathode 20 is fitted so that its ends 22 and 22' are guided around the edges 23 and 23' of the support cylinder. The support cylinder is preferably made of plastic, e.g., polypropylene. However, it may also be manufactured of a metallic material and may on its inside, at least up to above the electrolyte level, be coated with a resin powder to meet the requirements of insulation and corrosion. The slots 21 are narrow and adjusted to the material of mantle cathode 20. They are 2–5 mm wide and extend essentially parallel to the rotation axis of the drive shaft; however, they may also be arranged at an oblique angle. Suitable mantle cathodes are thin, flexible materials, e.g., Cu foils with a thickness of 15–150 μm, preferably 70 μm, or a polypropylene weave of 50–500 μm thickness, or an electrically conducting polypropylene foam with a thickness of 3–5 mm that is openporous and has low ohmic resistance. Such mantle cathode materials are economically available in rolls. For its installation on the support cylinder, the mantle cathode material is cut to length and the ends of the resulting sections are trimmed so that they can simply be inserted into the slot. After insertion of a contact rod—as described further down—results such a mantle cathode that lies flat on the support cylinder. Thereby an exactly defined geometry is given relative to the anode arrangement, which is essential for a homogeneous deposition. The slot widths are now selected for the chosen mantle cathode materials such that deposition is effectively prevented behind the slot. Behind slot 21 is situated a contact chamber 25 that extends parallel to the slot and is formed by profile 24 and support cylinder 11. The profile 24 is fastened to the support cylinder at points 26 and 26', preferably welded on. Contact chamber 25 is here indicated in a square form and is intended for contacting.

Figure 3:
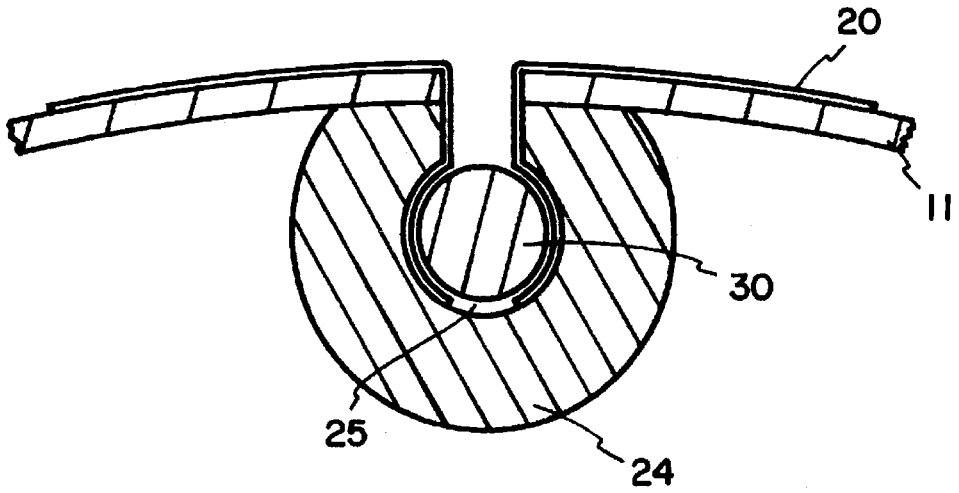
FIG. 3 Part of a support cylinder in section after introduction of the contact rod.

FIG. 3 depicts a part of the support cylinder in section after insertion of the contact rod. Support cylinder 11 and mantle cathode 20 with the ends 22 and 22' correspond to FIG. 2. The contact chamber 25 is here essentially cylindrical and is realized by a pipe 24. The contact rod 30 effects the establishment of contact with mantle cathode 20 for the current flow on the cathode side. Material and dimensions of the contact rod are selected such that contact is made over a large surface area and the fixation of the mantle cathode on the support cylinder can simultaneously occur without need for additional means for their fixation. This has proven to be especially advantageous, obtaining the highest electrolytespecific current densities, preferably 1–10 amp/dm$^2$, and resulting in a compact, mechanically stable metal layer without observation of disturbed depositions. Contact rod 30 was selected with a circular cross section, but may also have a cross section deviating from this, e.g., a hexagonal one; essential is that through the choice of material and dimension, specifically diameter and shape of the cross section, an optimal forced contact-making is achieved which is matched/adjusted to the applied materials of the mantle cathode. Surprisingly, the use of a contact rod of the described kind resulted in a completely tensioned mantle cathode—also with use of razor-thin foils—that laid flat on the support cylinder. Furthermore, the manipulation of this form of fastening proved to be trouble-free, simple and fast, confirmed by a good reproducibility of the obtained deposits.

Figure 4:
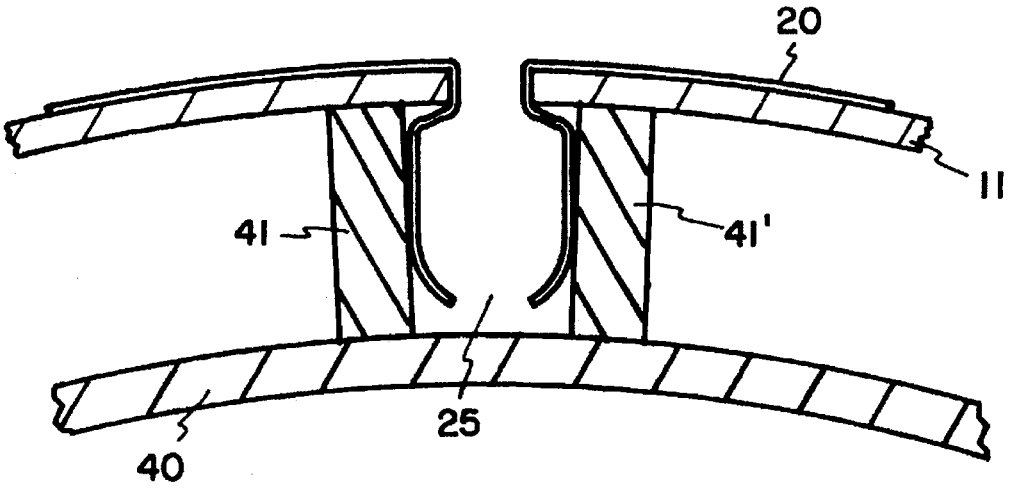
FIG. 4 Example of form of execution of a contact chamber.

FIG. 4 depicts an example of execution of a contact chamber. A second cylinder 40 is located behind support cylinder 11, having a smaller diameter than support cylinder 11. The inner cylinder 40 is connected to support cylinder 11 over the connecting structures (bridges) 40 and 41'. This creates a contact chamber 25 that is of approximately square or rectangular form, in which the mantle cathode 20 can be brought in contact with a square or rectangular contact rod over a large surface area.

Figure 5:
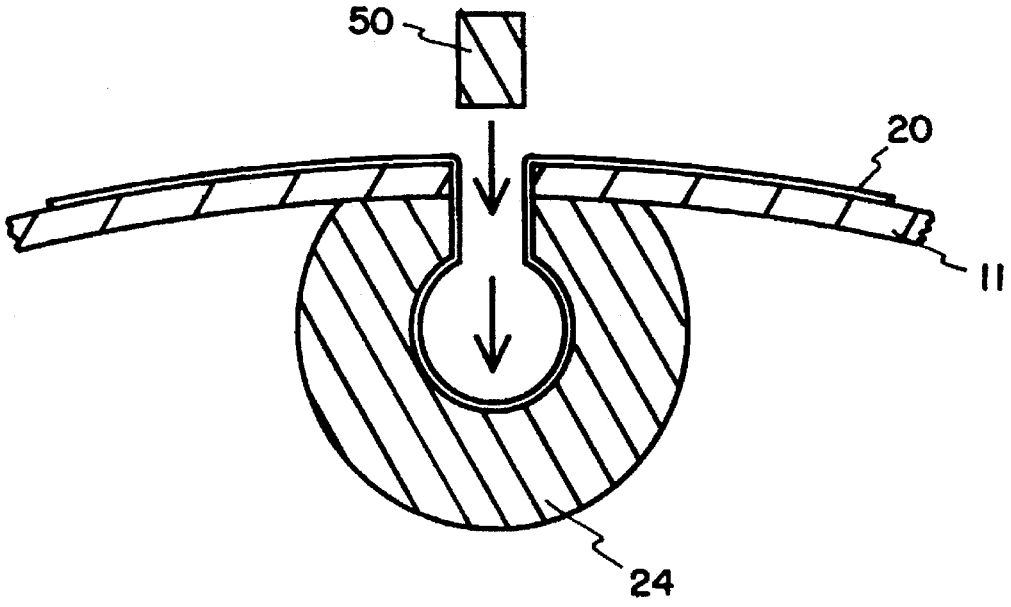
FIG. 5 Example of form of execution of a mantle cathode as a(n) continuous/endless hose.

FIG. 5 depicts an example of execution of a mantle cathode as a continuous hose. Here again, the contact chamber 25 was created with a pipe 24. As mantle cathode 20 a hose-shaped, net-like material was used that is available as an endless hose and is cut into pieces according to the application. The cut hose piece is pulled over support cylinder 11 and with a plate 50, serving as an installation tool, pushed in direction of the arrow into the slot so that after removal of the installation plate contact can be achieved in a simple and assured manner. Preferentially used for this example of execution are support cylinders with diametrically opposed slots, resulting in excellent contact and guaranteed flat surfaces of the mantle cathode. By the application of a second slot is such achieved a frequently desired doubling of the contact surface.

Example 1 describes an electrolysis of a solution of a Cu-containing standing rinse bath that had been installed following a Cu electrolyte with 60 g/l copper. Used as mantle cathode was a 70 mμ Cu foil with the measurements 0.25 m×0.438 m and a cathode surface of 0.344 m$^2$. The cathode system rotated at 16 rpm. Current density was approximately 1 amp/dm$^2$. The batch volume was 100 l with a starting concentration of 4 g/l . The end concentration after 15.3 hrs was approx. 1.2 mg/l , indicating a degree of efficiency of 64%.

Example 2 describes an electrolysis of a solution of an Ag-containing, cyanide-containing stationary rinse bath, situated following an Ag-cyanide electrolyte. As mantle cathode was again a 70 mμ Cu-foil used with the measurements 0.25 m x 0.438 m and a cathode surface area of 0.344 m$^2$. The cathode system rotated at 16 rpm. Current density was approximately 1 amp/dm$^2$. The batch volume was 100 l with a starting concentration of 1.74 g/l. The end concentration after 13.8 hrs was approx. 1.5 mg/l, indicating a degree of efficiency of 9.1%.

Example 3 describes an electrolysis of a solution of an Ag-containing, cyanide-containing stationary rinse bath situated following an Ag-cyanide electrolyte. As mantle cathode was again a 70 mμ Cu-foil used with a cathode surface area of 7 dm$^2$. The cathode system rotated at 16 rpm. The batch volume was 30 l with a starting concentration of 1.74 g/l. The end concentration after 49 hrs was approx. 1 mg/l, indicating a degree of efficiency of 7%.

Example 4 describes an electrolysis of a solution of a Cu-containing bath containing a $CuSO_4$ electrolyte with 14 g/l copper. The mantle cathode had a cathode surface of 35 dm$^2$ and was rotated at 30 rpm. The bath volume was 120 l. Current density was approximately 1.5 amp/dm$^2$ at a cell current of 52 amp. The starting concentration was 14 g/l, the end concentration after 28.5 hrs was below 0.1 mg/l, indicating a degree of efficiency of 95.7%.

Example 5 describes an electrolysis of a solution of an Au-containing bath with a starting concentration of 400 mg/l gold. The mantle cathode had a cathode surface area of 7.3 dm$^2$ and a rotation speed of 12 rpm. Bath volume was 30 l, pH-value was 4.5. The current density was approx. 0.1 amp/dm$^2$ at a cell current of 0.73 A. The anodes where platinized titanium. The electrolyte flow was directed onto the cathode, increasing the agitation of the electrolyte. The final concentration after 16 hrs was approx. 1 mg/l, indicating a degree of efficiency of 13.9%. In total, 12 g gold were deposited in this separation corresponding to 1.02 g/ampere hours.

The device and process of the described type find application in the (waste) removal of metals from metal-containing solutions having sufficiently high electrical conductivity; but also in the depletion of such solutions for the purpose of recycling them after a certain time of electrolytical treatment back into the work process. This is, e.g., of interest in etching solutions and electrolytes of all kinds that change during the work process, which can lead to undesirable metal concentrations.

Essential for the invention is that the inventive solution to the problem is distinguished by a simple handling of the support cylinder with mantle cathode, especially in regard to the removal of the electrolytical deposit from the metal cathode, and by the choice of the mantle cathode material, since the latter can be optimally tailored to a particular electrolytic deposition.

We claim:

1. Device for the electrolytic deposition of metals in a metal recovery cell, where the metal recovery cell essentially consists of a vessel, an electrolyte, an anode arrangement, a rotating cathode system, means for controlled drive of the rotating cathode, and of means for current supply, characterized in that the rotating cathode system in the metal recovery cell comprises:

a support cylinder rotatably mounted on a drive shaft, said support cylinder having at least one slot and at least one contact chamber situated behind said slot, said driving shaft being connected with said means for current supply and means for rotating said driving shaft together with said support cylinder mounted thereon, at least one mantle cathode removably mounted on said support cylinder, and a contact rod enclosed by said contact chamber and in contact with a portion of said mantle cathode extending through said slot into said contact chamber.

2. Device according to claim 1, characterized by that the support cylinder is made of plastic or of metal.

3. Device according to claim 1, characterized by that the slots extend essentially parallel to the axis of rotation.

4. Device according to claim 1, characterized by that the contact chamber installed parallel to slot is formed by an installed pipe.

5. Device according to claim 1 characterized by that the contact chamber extending essentially parallel to slot is formed by a second and smaller cylinder that is concentric to the support cylinder, where the cylinder is fastened to the support cylinder by bridges so that the contact chamber is confined.

6. Device according to claim 1, wherein the contact rod has a polygonal cross-section and has a tapered lower part.

7. Device according to claims 6, characterized by that the drive shaft is a hollow shaft, in the void of which an electrical conductor is provided for the current supply.

8. Device according to claims 6, characterized by that the drive shaft is simultaneously provided as electrical conductor for the current supply and consists of a metal alloy, preferably of hard bronze or hard copper.

9. Device according to claim 6, wherein the contact rod has a 6-sided cross-section.

10. A method of operating an electrolytic deposition device, the method comprising the steps of:

putting a mantle cathode on to a support cylinder;

introducing said mantle cathode through a slot in the support cylinder into a contact chamber;

fastening said mantle cathode to said support cylinder by introducing a contact rod into said contact chamber and, at the same time, making intimate contact between said mantle cathode and said contact rod over substantially the whole length thereof;

mounting said support cylinder on a flange of a driving shaft;

supplying an electrolyte to a container containing the support cylinder;

rotating said driving shaft; and connecting current supply means with said driving shaft and said contact rod.

11. The method of claim 10, wherein the electrolyte is an electrically conducting solution containing metal to be removed from the solution.

12. The method of claim 10 wherein the electrolyte is an electrically conducting solution containing metal, and the method further comprises the steps of removing metal from the solution and recycling the solution to a work process.

* * * * *